US007308108B2

(12) United States Patent
Davis

(10) Patent No.: US 7,308,108 B2
(45) Date of Patent: Dec. 11, 2007

(54) HELMET-MOUNTED INTERCOMMUNICATIONS AND ENTERTAINMENT SYSTEM

(76) Inventor: William E. Davis, 2416 Passage Key Tr, Xenia, OH (US) 45385

( * ) Notice: Subject to any disclaimer, the term of this patent is extended or adjusted under 35 U.S.C. 154(b) by 222 days.

(21) Appl. No.: 10/907,670

(22) Filed: Apr. 11, 2005

(65) Prior Publication Data

US 2005/0226451 A1 Oct. 13, 2005

Related U.S. Application Data

(60) Provisional application No. 60/521,370, filed on Apr. 10, 2004.

(51) Int. Cl.
*H04R 25/00* (2006.01)

(52) U.S. Cl. ..... 381/376; 381/370; 381/432

(58) Field of Classification Search ..... 381/370, 381/374, 375, 376; 379/430; 455/66.1, 455/90.3, 348, 351; 2/209, 209.13, 906
See application file for complete search history.

(56) References Cited

U.S. PATENT DOCUMENTS

| | | | | |
|---|---|---|---|---|
| 4,109,105 A | | 8/1978 | Von Statten | |
| 4,636,592 A | | 1/1987 | Scott | |
| 4,788,724 A | | 12/1988 | Lazzeroni | |
| 4,977,975 A | | 12/1990 | Lazzeroni | |
| 5,136,657 A | | 8/1992 | Hattori | |
| 5,404,577 A | * | 4/1995 | Zuckerman et al. | 455/66.1 |
| 5,678,205 A | * | 10/1997 | Gray | 455/90.3 |

* cited by examiner

*Primary Examiner*—Huyen Le
(74) *Attorney, Agent, or Firm*—R. William Graham

(57) ABSTRACT

An improved headset for a helmet includes an acoustic component of a relatively small size to permit insertion thereof within the helmet, a relatively soft and comfortable textile material configured to removably contain the acoustic component, a connector for removably retaining the textile material to an inner portion of the helmet, and power supply for energizing the acoustic component causing emission of a sound wave. The textile material can be formed into a pouch.

5 Claims, 5 Drawing Sheets

HELMET-MOUNTED INTERCOMMUNICATIONS AND ENTERTAINMENT SYSTEM

This is a continuation of U.S. Ser. No. 60/521,370 filed Apr. 10, 2004.

BACKGROUND OF THE INVENTION

1. Field of the Invention

The present invention relates to the field of audio loudspeaker, microphone and transducer enclosures fitting within the confines of a helmet which is worn during various activities in which it is desired to utilize a separate source of inter-communications or entertainment system via wired or wireless connection to the helmet from such a source.

2. Description of the Related Art

In recent years, helmet wearers have encountered a wide array of methods by which audio content can be delivered to and transmitted from a helmet such as a motorcycle or racing car helmet, for example, but not intended to exclude other kinds of helmets and applications. In most cases, it is cumbersome to attach transducers such as speakers and microphones inside the confines of a properly fitted helmet, especially safety helmets, because of the design of protective padding. More difficult still is the challenge of installing and removing such equipment while maintaining a safe and comfortable fit of the helmet. Further, it is critical to design speaker enclosures which allow for optimum performance of a speaker while maintaining a low profile, proper acoustical venting of transducers for performance, and easy mounting, removal and adjustment in a single enclosure that fits easily into a helmet.

While related art has been advanced to address installation methods of the various components (Van Stratten, U.S. Pat. No. 4,109,105) (Hattori U.S. Pat. No. 5,136,657) (Scott U.S. Pat. No. 4,636,592) (Lazzeroni, U.S. Pat. No. 4,788,724) and even the performance of helmet mounted audio systems in high noise environments (Lazzeroni U.S. Pat. No. 4,977,975), little or nothing has been done to facilitate the quick and removably-connectable installation of audio systems in helmets, nor the transportability from one helmet to another of audio systems, nor the modularity of design of the overall headset in which these components are used in such a way that facilitates re-configuration of the headset components for various and differing purposes and applications inside the helmet without complete removal and re-installation of the audio system or components. Similarly, little has been done to improve the comfort of the helmet with speakers and similar devices installed or mounted inside, while using the same mounting apparatus to also provide comfort and acoustic performance elements built into them.

In the 1998 U.S. Pat. No. 4,788,724, a method of clamping a combination microphone and electrical connector to a helmet was described. However, the act of clamping a device of any kind to the shell of a helmet bears considerable risk to the integrity of the helmet shell from potential stress fractures induced by clamping a rigid object to a semi-rigid helmet shell of a different overall shape where the clamping occurs. Doing so may actually void U.S. Department of Transportation certifications on safety. It is generally accepted that even dropping a motorcycle helmet on the floor or ground indicates replacing the helmet since it cannot be assured that it will perform as designed in an accident after the stresses induced by simply dropping it.

The present invention solves the foregoing problems.

SUMMARY OF THE INVENTION

It is an object to improve the manner in which audio content can be delivered to and transmitted from a helmet.

It is another object to provide a quick and removably-connectable installation of an audio system in a helmet.

It is still another object to enable an audio system to be readily transportability from one helmet to another.

A further object is to provide easy reconfiguration of acoustic components within a helmet to meet needs of users in distinct situations requiring differing headset configuration.

Another object is to provide an improved speaker pouch mounting assembly which maintains the safety and comfort of the inside liner of the typical helmet.

Still another object is to provide an improved speaker pouch mounting assembly that optimizes sonic performance of the speaker within the body of the speaker pouch itself by the design of the assembly while eliminating the need for venting tubes or other cumbersome methods of properly porting a speaker for acoustic performance.

It is another object of the subject invention to provide a motorcycle helmet vented speaker enclosure which retains the comfortable nature of the typical helmet liner, while maintaining hi levels of fidelity and performance of the speaker by enclosing it in a material similar in nature to the helmet liner itself and designing it to maximize sonic performance.

It is yet another object to provide a removable washable pouch for retaining an acoustic component therein within a helmet.

Accordingly, an embodiment of the present invention is directed to an improved headset for a helmet. The headset includes an acoustic component of a relatively small size to permit insertion thereof within the helmet, a relatively soft and comfortable textile material configured to removably contain the acoustic component, a connector for removably retaining the textile material to an inner portion of the helmet, and a power supply for energizing the acoustic component causing emission of a sound wave. The textile material can be configured as a pouch having one or more ports such that when containing the acoustic component, the port permits migration of the sound wave therethrough. The retaining connector can include a first member having a first side configured to affix to an inner surface of the helmet and a second side having a removably connectable surface extending outward therefrom and a second member having a first side configured to affix to a portion of the textile material and a second side having a removably connectable surface extending outward therefrom which is complementary configured to the second side of the first member to removably connect thereto, wherein when so connected retains the textile material and acoustic component in relatively fixed position.

Another embodiment is directed to a pouch for carrying an acoustic element within a helmet. The pouch includes a relatively soft and comfortable textile material configured to removably contain the acoustic component and a connector for removably retaining the textile material to an inner portion of the helmet. The pouch can be configured with a port such that when containing the acoustic component, the port permits migration of a sound wave therethrough. The pouch can include first member and second member connector members as described and a flap portion having a third connector member to removably connect to a portion the first connector member.

One embodiment of the invention described consists of a method of installation, reconfiguration, and helmet-to-helmet transportation of audio components, while maintaining the safety and comfort of the properly fitted helmet, as well as optimizing the acoustic performance of audio components and transducers by creative design of the mounting elements. Due to the availability of closed helmets and open faced helmets, the invention addresses mounting methods for each.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

DETAILED DESCRIPTION OF THE INVENTION

Figure 1:
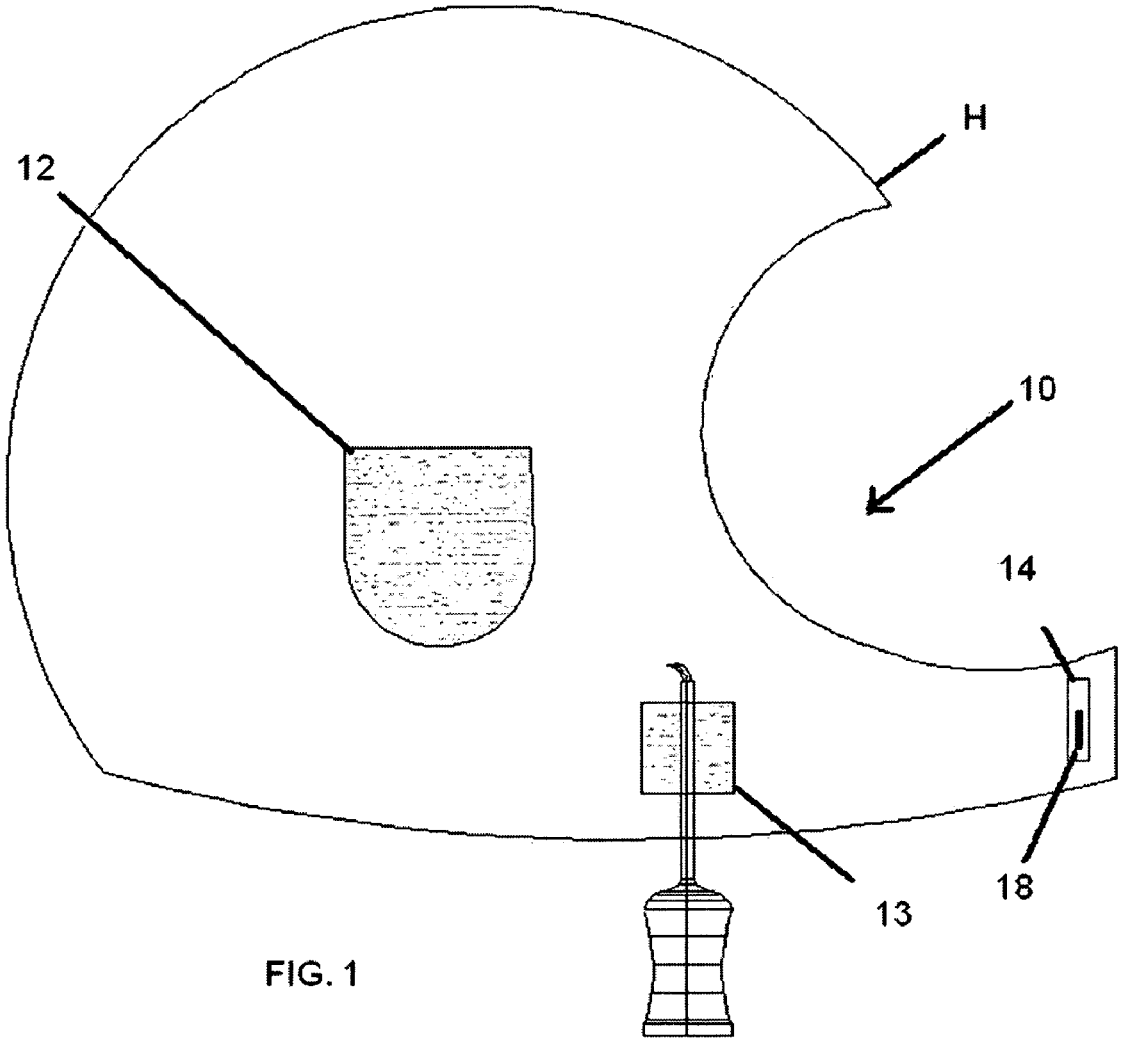
FIG. 1 is a schematic showing the acoustic system for use in a helmet of the invention.
Figure 2:
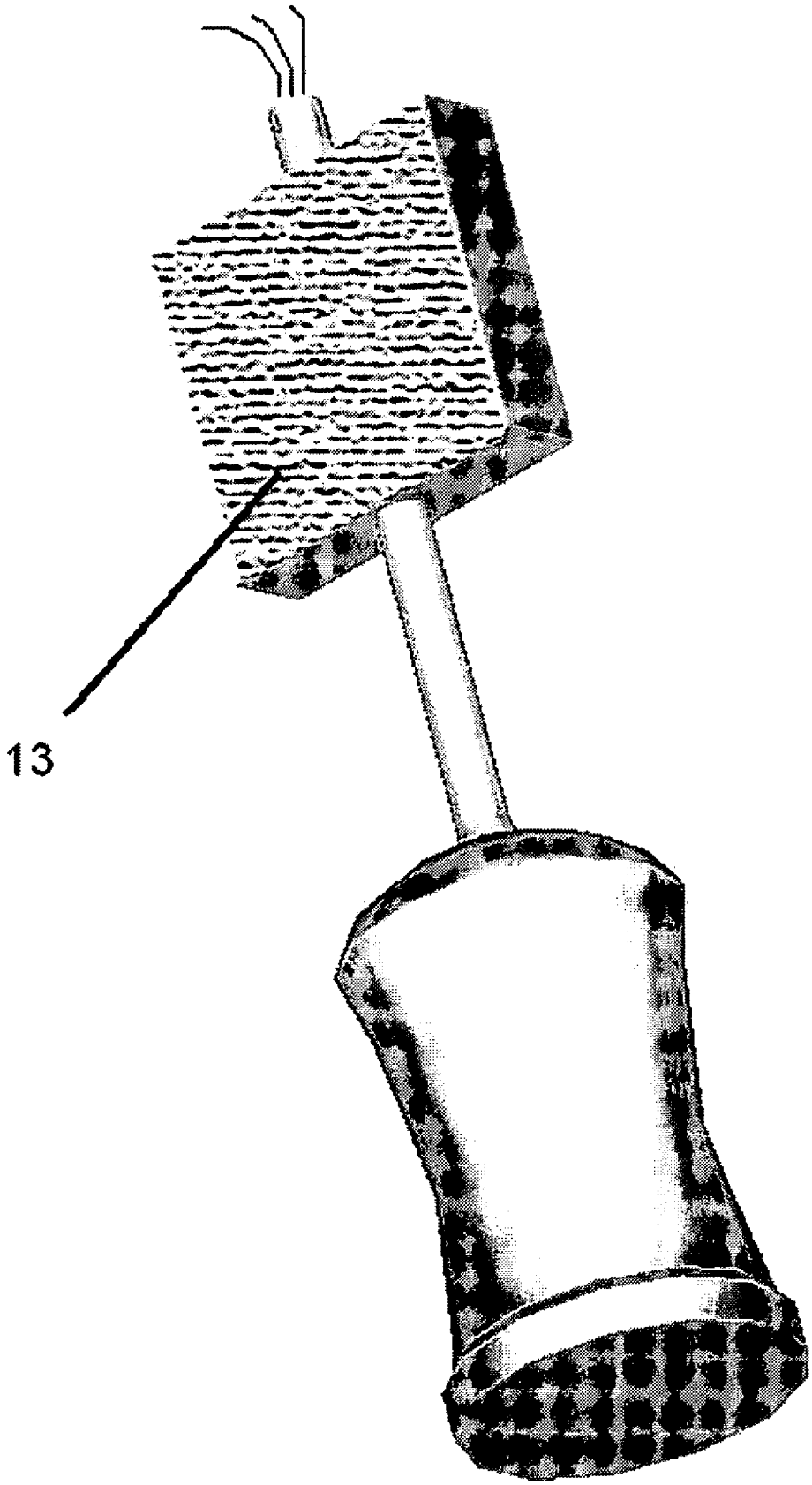
FIG. 2 is perspective view of a power supply connector for use with the invention.
Figure 3:
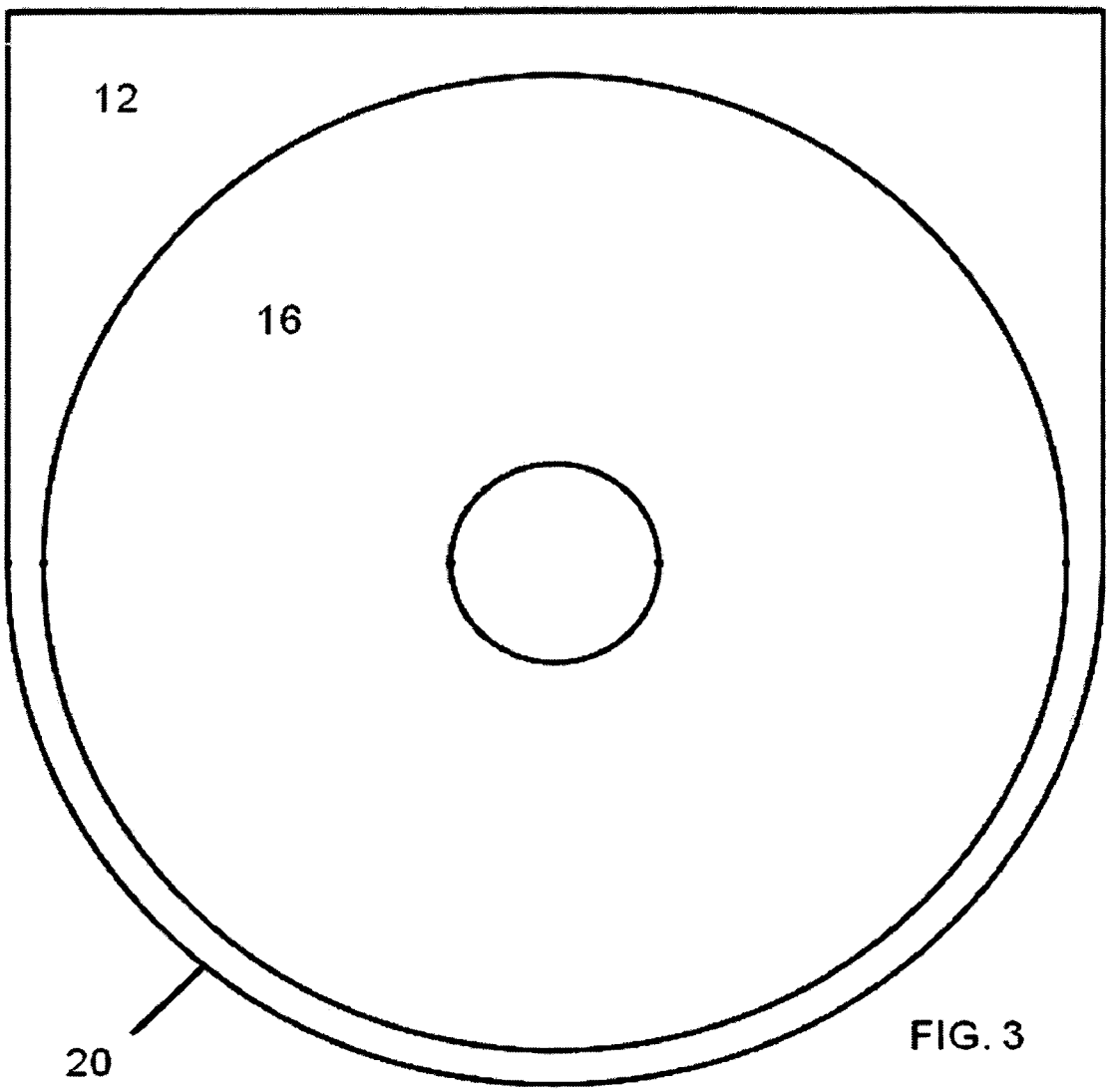
FIG. 3 is a front view of a speaker and pouch of the invention.

Referring now to the drawings, an acoustic helmet system of the present invention is generally referred to by the numeral 10. By way of example, but not for the purpose of limiting the invention, a helmet H includes a removably disposed speaker pouch 12, removable acoustic component energizing connector 13 and removably disposed microphone pouch 14.

Two components of the acoustic helmet system 10 include one or more speakers 16 and microphone 18 (acoustic components) which provide a communications and entertainment system. Their disposal in pouches 12 and 14, respectively allow them to perform in an optimum way, be easily adjusted, removable, and not compromise the structural integrity of the helmet H itself.

The pouches 12 and 14 are made of a soft and comfortable acoustically transparent textile material, such as foam lined nylon or other synthetic woven textile fibers.

Figure 4:
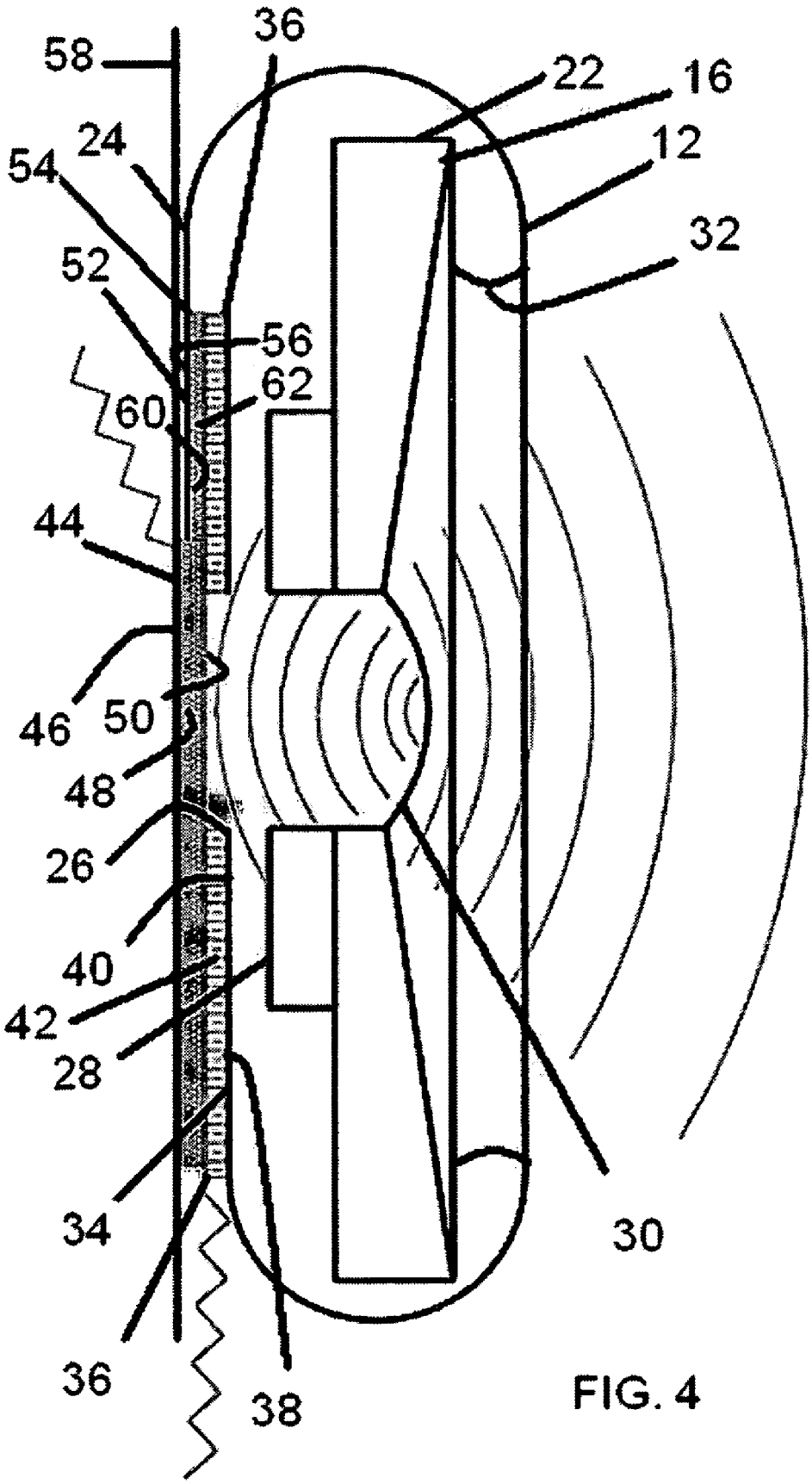
FIG. 4 is a cross-sectional view of a speaker pouch of the invention.
Figure 5:
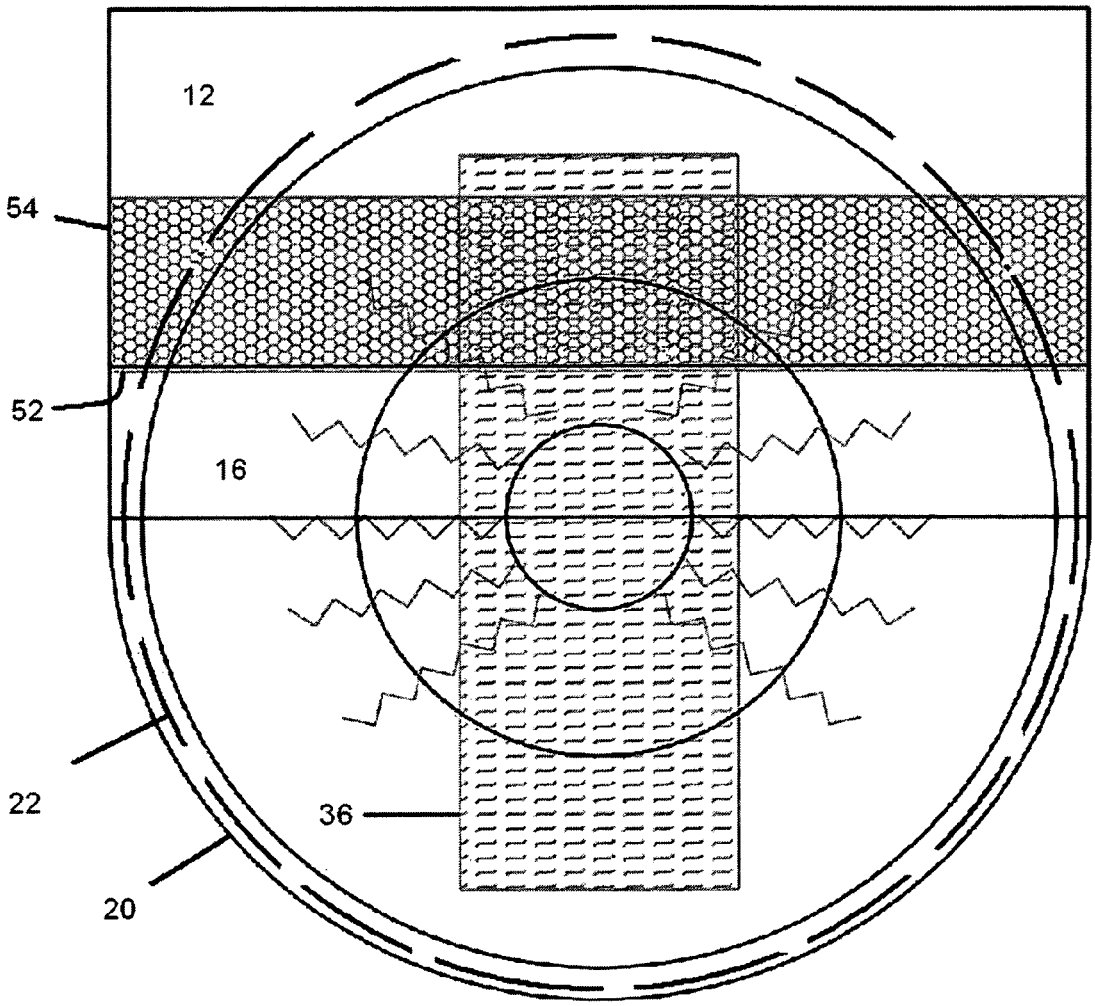
FIG. 5 is front view of a speaker and pouch of the invention illustrating wave dissipation when installed in a helmet.

The speaker pouch 12 includes an annular suspension portion 20 which is configured to retain an outer rim 22 of the speaker 16 and further includes an openable end portion 24 best seen in FIG. 4 through which the speaker 16 can be inserted and removed. The speaker pouch 12 includes a back port 26 which is configured for disposal adjacent a back side 28 of the speaker 16 to allow pressure (sound) waves to pass unencumbered therethrough and allow freedom for the speaker cone 30 to move, thereby improving and maximizing the sonic performance of the speaker 16.

Additionally, the speaker pouch 12 can include a front port 32 to readily permit sound wave propagation.

To a back portion 34 surrounding the back port 26 is connected a first connectable member 36 having a first side 38 configured to affix to the back portion 34 and a second side 40 having a removably connectable surface 42 extending outward therefrom. A second connectable member 44 is provided having a first side 46 configured to affix to an inner surface of the helmet H and a second side 48 having a removably connectable surface 50 extending outward therefrom which is complementary configured to said second side 40 of said first connectable member 36 to removably connect thereto, wherein when so connected retains said pouch 12 and speaker 16 in relatively fixed position to the helmet H.

Additionally, the open end portion 24 includes a flap 52 which has a third connectable member 54 having a first side 56 configured to affix to an inner side 58 of the helmet H and a second side 60 having a removably connectable surface 62 extending outward therefrom which is complementary configured to a portion said second side 40 of said first connectable member 36 to removably connect thereto. Thus, another portion of the second side 40 remains exposed for connection to member 44.

The members 36, 44 and 52 can be made of conformable mounting tabs or surfaces of the type available from 3M known as Dual-Lock and Velcro. These relatively thin mounting or supporting devices serve both to connect each component to the helmet H and transportability to another helmet where a similar mounting tab is used. In construction, the members 36, 44 and 52 can include a circular disk or rectangular tab having a dimension and thickness compatible with the intended use, wherein the circular disk or rectangular tab being of either a mushroom-shaped self-interlocking protrusions design (3M-Dual Lock) or of a hook and loop type design (Velcro).

With the use of such components in the invention, it is not necessary to attempt to carry away the pressures waves generated by movement of a speaker cone 30 towards the outside of the helmet H. The subject invention is configured such that these pressure waves are simply distributed directly into a cavity made by orientation and configuration of the back port 26 and members 36 and 44. Thus, the pressure waves are muted similarly to how sound waves are muted in a recording studio by impingement on soft surfaces that are designed to absorb the energy of the pressure wave, such will the soft surfaces of the Velcro hooks and loops dissipate the pressure waves emanating from the rear of the speaker pouch.

This method of dealing with pressure waves that are normally ported away from the listener is both simpler, smaller in design and execution, and more effective than other methods of removing impediments to free vibration of speaker components. Given that the front side of a speaker pouch 12 is satisfactorily acoustically transparent, so shall the rear side of the same pouch 12, thereby allowing maximum performance. In the case of tuning the speaker pouch 12 for maximum reproductive fidelity, the size and number of openings, and their physical location can easily be altered to achieve the highest fidelity reproduction of signals with minimized distortion and loss of efficiency just as in the case of porting a rigid speaker enclosure such as a box. Similarly, so can the Velcro mounting be oriented and distributed to allow for maximum performance of the design. This method of maximizing a speaker's performance inside a soft pouch is equivalent to what is known as porting in a typical speaker box. By these such measures, any destructively interfering sound waves emanating from the rear of the speaker enclosure are distributed into and muted by the soft liner and materials of the internal cavity in which the speaker is mounted.

In motorcycle helmets and other types of helmets, typically inside an outer shell is situated an inner protective liner having a thickness of ½to 1 inch. Within that inner liner proximate the position of a wearer's ears, an ear pocket is formed by removal of at least a part of the inner liner. The pouches 12 and 14 of subject invention are adapted to be placed within that formed ear pocket. As stated above, member 44 serves to attach to the helmet shell and removably connect to the member 36 to retain the pouch 12 within the formed pocket. By this method, the pouch 12 is removable at will and its design is such that each component serves multiple purposes of mounting and maximizing comfort and sonic performance, making the subject invention an improvement over all other methods of mounting speakers inside helmets.

By so providing, the above objects have been met. Thus, the invention provides for a mounting pouch for microphone elements and similar transducers that provides both mounting and acoustic wind filtering in one assembly, maintaining the desirable feature of noise canceling capability when used with multi-ported microphone elements that provide diaphragm-neutral response to ambient equal-pressure noise thereby canceling ambient noise. Further, the invention provides for an easily removable pouch using a mounting element, such a patch for microphone elements, speakers and similar transducers which are removable for purposes of cleaning without damaging the hosted acoustic transducers due to the design and which can preferably include washable textile fabrics and woven goods. Also, a simple and low cost removable fastener mounting system is provided for boom microphones, and electrical connectors for use in helmets that does not damage, either cosmetically or architecturally, the structure of the helmet itself in a way that clamps or bolts of screws or other friction/pressure based mounting methods do, thereby maintaining safety and crashworthiness certifications that may be granted to the helmet manufacturer.

The above described embodiments are set forth by way of example and are not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. An improved headset for a helmet, which includes:

an acoustic component including a speaker of a size approximately not exceeding that of an ear area on the helmet and having a cone with a back side and a front side;

a relatively soft and comfortable textile material forming a pouch configured to directly removably contain said speaker and wherein said textile material is configured with a back port of a size approximate that of said speaker cone back side and a front port of a size approximate that of said front side of said speaker such that when containing said acoustic component, said ports permit migration of a sound wave therethrough which is generated by said speaker and thereby permitting enhanced free movement of said cone and improved performance thereof and wherein said pouch is of a size slightly greater than said speaker;

means for removably retaining said textile material to an inner portion of the helmet; and means for energizing said acoustic component causing emission of the sound wave.

2. The improved headset of claim 1, wherein said retaining means includes a first member having a first side configured to affix to an inner surface of the helmet and a second side having a removably connectable surface extending outward therefrom and a second member having a first side configured to affix to a portion of said textile material and a second side having a removably connectable surface extending outward therefrom which is complementary configured to said second side of said first member to removably connect thereto, wherein when so connected retains said textile material and acoustic component in relatively fixed position.

3. A pouch for carrying a speaker within a helmet, which includes:

a relatively soft and comfortable textile material configured to removably contain the speaker and is of a size approximately not exceeding that of an ear area on the helmet, wherein said textile material is configured with a back port of a size approximate that of a speaker cone back side and a front port of a size approximate that of a speaker front side such that when containing the speaker, said ports permits migration of a sound wave therethrough which is generated by said speaker and thereby permitting enhanced free movement of said cone and improved performance thereof; and means for removably retaining said textile material to an inner portion of the helmet.

4. The pouch of claim 3, wherein said retaining means includes a first member having a first side configured to affix to an inner surface of the helmet and a second side having a removably connectable surface extending outward therefrom and a second member having a first side configured to affix to a portion of said textile material and a second side having a removably connectable surface extending outward therefrom which is complementary configured to said second side of said first member to removably connect thereto, wherein when so connected retains said textile material and acoustic component in relatively fixed position.

5. The pouch of claim 4, wherein pouch includes a flap portion having a third member having a first side configured to affix to a portion of said textile material and a second side having a removably connectable surface extending outward therefrom which is complementary configured to said second side of said first member to removably connect to a portion thereof, wherein when so connected retains encloses said acoustic component in retained manner.

* * * * *